US007293335B2

(12) United States Patent
Tseng et al.

(10) Patent No.: US 7,293,335 B2
(45) Date of Patent: Nov. 13, 2007

(54) SLIDER FOR SLIDE FASTENER

(75) Inventors: Fa wen Tseng, Taoyuan County (TW); Hideyuki Matsushima, Taipei (TW); Hisashi Yoneshima, Taipei (TW)

(73) Assignee: YKK Corporation, Tokyo (JP)

( * ) Notice: Subject to any disclaimer, the term of this patent is extended or adjusted under 35 U.S.C. 154(b) by 69 days.

(21) Appl. No.: 11/043,778

(22) Filed: Jan. 26, 2005

(65) Prior Publication Data

US 2005/0166371 A1 Aug. 4, 2005

(30) Foreign Application Priority Data

Jan. 29, 2004 (JP) ..... 2004-021603

(51) Int. Cl.
*A44B 19/26* (2006.01)

(52) U.S. Cl. ..... 24/429; 24/415

(58) Field of Classification Search ..... 24/415–425, 24/429–431

See application file for complete search history.

(56) References Cited

U.S. PATENT DOCUMENTS 1,988,761 A 1/1935 Towner ..... 24/431
2,238,823 A * 4/1941 Rosenthal ..... 24/416
2,494,249 A * 1/1950 Krupp ..... 24/389
6,769,156 B1 * 8/2004 Chen ..... 24/421
2004/0020017 A1 * 2/2004 Nedbal et al. ..... 24/429
2004/0050017 A1 * 3/2004 Thomas et al. ..... 53/412
2005/0076480 A1 * 4/2005 Chen et al. ..... 24/415

* cited by examiner

*Primary Examiner*—James R. Brittain
*Assistant Examiner*—Ruth C. Rodriguez
(74) *Attorney, Agent, or Firm*—Everest Intellectual Property Law Group; Michael S. Leonard

(57) ABSTRACT

A slider for a slide fastener having a cover member capable of rotating between a first position at which a pull tag is concealed in an immobile state and a second position at which the pull tag is exposed, wherein engaging/disengaging means for engaging with/disengaging from each other when the cover member is located at the first position is provided at a portion on first end portions side apart from respective rotating portions of second end portions, the second end portion having the rotating portions in which the pull tag and the cover member are coupled so as to be able to rotate relatively, thereby providing the slider a simple structure and costing low, being capable of achieving a pull tag holding performance stable and excellent over a long period and preventing deflections between respective components.

9 Claims, 9 Drawing Sheets

SLIDER FOR SLIDE FASTENER

BACKGROUND OF THE INVENTION

1. Field of the Invention

The present invention relates to a slider for a slide fastener, and more particularly to a slider capable of achieving a pull tag holding performance stable and excellent over a long period and preventing occurrence of plays between respective components.

2. Description of Related Art

Conventionally, sliders have been often used as fixing devices for articles such as bag or knapsack and clothes such as jacket or sweat suit. As for the structure of this kind of slider, there is available an ordinary slider comprising a slider body made of a stiff material, which is attached to an opening of the aforementioned articles and engages with/disengages from engaging elements opposing of a pair of fastener stringers, and a pull tag made of a stiff material connected to the slider body so as to be capable of moving freely.

As for another structure of the slider, there is available a slider comprising a slider body, a pull tag and a cover member for covering the slider body and pull tag according to U.S. patent publication No. 1988761. The slider having such a cover member has been often used as a fixing device for clothes a motorcyclist wears. This clothes is manufactured of leather, artificial leather or material of the same property and generally expensive.

In a slider 100 disclosed in U.S. patent publication No. 1988761, as shown in FIG. 16, a flat hard cover plate 101 is connected to a pull tag 102 hingedly. This cover plate 101 is capable of moving between a first position for concealing an unornamental assembly comprised of a slider body 103 and the pull tag 102 and a second position for exposing the assembly. This cover plate 101 is disposed resiliently obliquely in a direction of making contact with an engaging element row 104 and its adjacent portion. As a result, a slider 100 having more superb decoration property can be obtained.

In the slider 100 described in the U.S. patent publication No. 1988761, the hard pull tag 102 is only connected to the hard slider body 103 so as to be capable of moving freely and the cover plate 101 is connected to the pull tag 102 so as to be capable of rotating. For this reason, when the slider is used as a fixing device for clothes which a motorcyclist wears, for example, the pull tag 102 often jumps up during usage due to its structure. If the pull tag 102 frequently jumps up over a long period, the pull tag 102 collides with the top face of the slider body 103 violently. Thus, not only a motorcyclist feels uncomfortable when he hears that collision sound frequently but also there occurs a play or deflection in position between respective components.

As for the cover plate 101 of this conventional slider 100, when the cover plate 101 is located at the first position for covering the assembly comprised of the slider body 103 and the pull tag 102, a hinge-like connecting portion between the cover plate 101 and the pull tag 102 is floated upward. Further, the cover plate 101 covers the pull tag 102 in a state in which a free end of the cover plate 101 keeps contact with the top face of the slider body 103.

That is, when the cover plate 101 is located at the first position for covering the slider body 103 and the pull tag 102, the cover 101 is disposed so as to be tilted in a direction of making contact with the engaging element row 104 and its adjacent portion. Thus, for example, in clothes which the motorcyclist wear, if the pull tag 102 frequently jumps up over a long period during usage, not only he feels unpleasantly therewith but also the free end of the cover plate 101 makes a direct contact with the engaging element row 104 and clothes. As a result, there occurs such an inconvenience that the clothes wears partially or is damaged.

An object of the present invention is to provide a slider for a slide fastener having a cover member capable of achieving a stable, excellent pull tag holding performance in a long period and preventing deflections between respective components, the slider having a simple structure and costing low.

SUMMARY OF THE INVENTION

To achieve the above-described object, according to a main aspect of the present invention, there is provided a slider for a slide fastener being characterized in that including: a slider body for engaging/disengaging engaging elements of a pair of fastener stringers; a pull tag connected to the slider body through a first end portion of the pull tag so as to be capable of moving freely; and a cover member including a second end portion of the cover member having a rotating portion of the cover member coupled with the pull tag through a rotating portion of the pull tag on the second end portion of the pull tag on an opposite side to the first end portion of the pull tag so as to be capable of rotating relatively, the first end portion of the cover member on an opposite side to the second end portion of the cover member being rotatable between a first position at which the pull tag is concealed in an immobile state and a second position at which the pull tag is exposed, wherein the pull tag and the cover member have engaging/disengaging means for engaging with/disengaging from each other when the pull tag and the cover member are located at the first position, the engaging/disengaging means being provided at a portion on the first end portions side apart from the rotating portions of the second end portions, respectively.

The slider of the present invention is comprised of three members, a slider body, a pull tag and a cover member like the U.S. patent publication No. 1988761. In the slider described in the U.S. patent publication No. 1988761, the connecting portion between the slider body and the pull tag and the rotating portion between the pull tag and the cover member are joined such that the respective members are capable of moving freely. Thus, it is impossible to suppress a tendency of frequency jump-up of the pull tag.

However, according to the slider of the present invention, due to provision of the above-mentioned configuration, the engaging/disengaging means can be provided reasonably within a rotation space which allows a relative rotation between the respective second end portions of the pull tag and the cover member when the cover member is located at the first position. When the pull tag is located at the first position at which the cover member conceals the pull tag, the pull tag becomes immobile thereby suppressing a motion of the pull tag. Consequently, a sufficient holding force to the pull tag can be secured. Further, because the pull tag causes no play or deflection in position respect to the slider body, the quality of the slider can be secured over a long period.

Preferably, one of the rotating portions of the pull tag and the cover member is formed in a pair of right and left arm portions having a rotation space allowing the rotating portions to rotate relatively, and the engaging/disengaging means for engaging with/disengaging from each other are provided in an inner side face of the arm portion in the pull tag or the cover member, and in an outer side face of the rotating portion in the cover member or the pull tag.

Consequently, it can be so constructed that the inner side face of the arm portion of the pull tag or the cover member engages with/disengages from the outer side face of the rotating portion in the cover member or the pull tag.

Preferably, one of the rotating portions of the pull tag and the cover member is formed in a pair of right and left arm portions having a rotation space allowing the rotating portions to rotate relatively, and a joint lever for joining respective arm portions is provided at a proximal end portion of the arm portion while an other of the rotating portions of the cover member and the pull tag has the engaging/disengaging means for engaging with/disengaging from the joint lever.

Consequently, the other of the rotating portions of the cover member and the pull tag can include a structure which engages with/disengages from the joint lever.

By providing with the respective slider structures, part of the second end portion having the rotating portion in which the pull tag and the cover member are coupled such that they are capable of rotating relatively can be used effectively as the engaging/disengaging means. Additionally, when the cover member is located at the first position, the pull tag and the cover member can be supported and fixed securely with respect to the slider body with the engaging/disengaging means. Consequently, a relative movement between the cover member and the pull tag can be prevented.

Preferably, one of the pull tag or the cover member has an engaging portion in which the engaging/disengaging means engages/disengages when the pull tag and the cover member are engaged/disengaged.

Preferably, the engaging portion is constituted of an elastic tongue piece which deforms elastically.

Preferably, the engaging portion is constituted of a projecting portion.

Preferably, the projecting portion is constituted of a cam face made of a hard material.

Preferably, an other of the cover member or the pull tag has an engaging/disengaging hole or a concave portion which engages with/disengages from the projecting portion.

By setting an engaging area between the engaging portion and the engaged portion appropriately, a sufficient holding force can be secured between respective components. Further, the engaging/disengaging means can be constructed in a simple structure thereby avoiding formation of a complicated structure. Consequently, reduction in size and thinning of the slider can be achieved and its handling is facilitated.

Preferably, the slider body has a pull tag mounting post on a part of a top surface thereof and an inner face of the cover member has an accommodating concave portion which is fit on the top end portion of the pull tag mounting post.

When the cover member is located at the first position for concealing at least the pull tag, the pull tag mounting post, the pull tag and the cover member can be engaged completely. Thus, any play and deflection between the respective components can be prevented and those components can be supported and fixed firmly and securely.

Thus, even if a force intending to jump up of the cover member with respect to the pull tag mounting post is applied directly to the cover member when the cover member is located at the first position for concealing at least the pull tag, the pull tag and the cover member can be prevented from moving in the back and forth direction, right and left direction, oblique direction and vertical direction by the engagement between the pull tag and the cover member.

The configuration of the accommodating concave portion can be set up appropriately depending on the configuration and size of the cover member and slider body. The cover member only has to be constructed in a simple structure and does not need to be constructed in a complicated structure. Thus, reduction in size and thinning of the slider can be achieved by setting the configuration and size of the accommodating concave portion in the cover member depending on the configuration and size of the pull tag mounting post. The effects which the present invention exerts are considerably great.

DESCRIPTION OF THE PREFERRED EMBODIMENTS

Hereinafter, embodiments of the present invention will be described specifically with reference to the accompanying drawings.

First Embodiment

Figure 2:
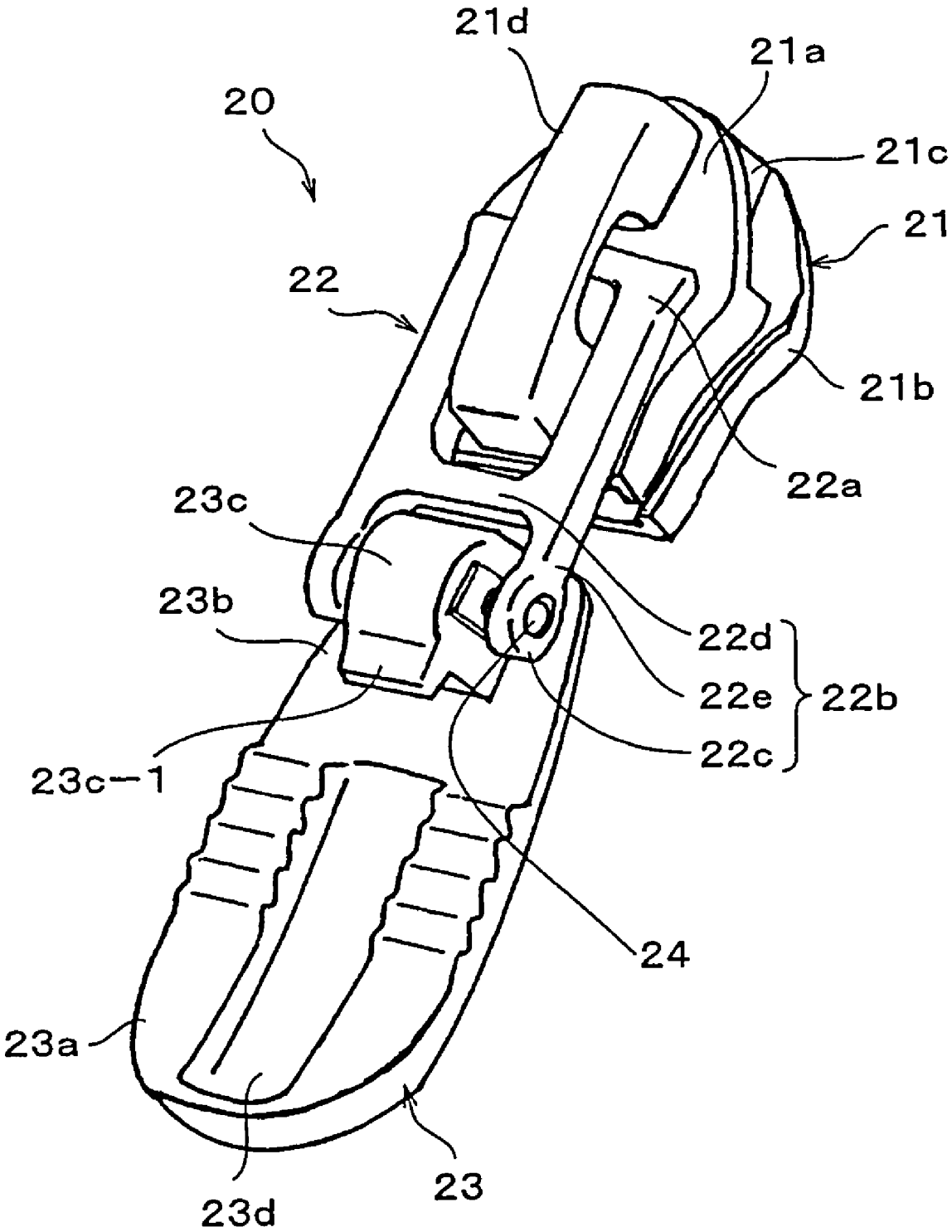
FIG. 2 is a perspective view showing a second state of the slider (first embodiment)
Figure 3:
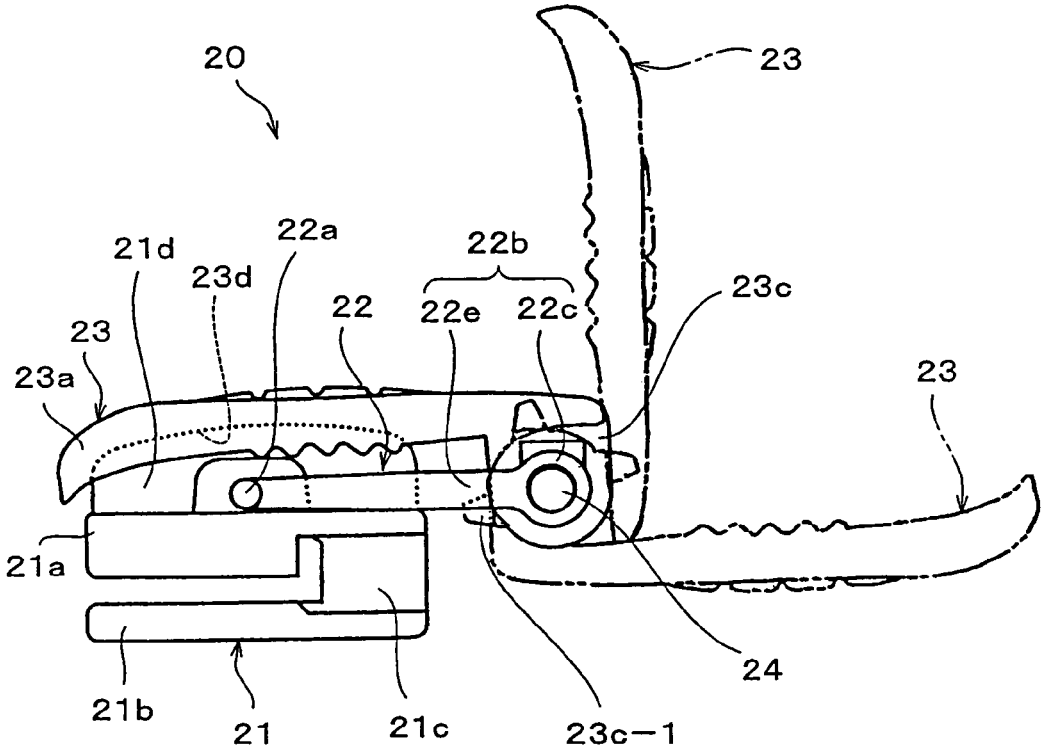
FIG. 3 is a side view showing that the cover member of the slider can be located at various positions (first embodiment)
Figure 4:
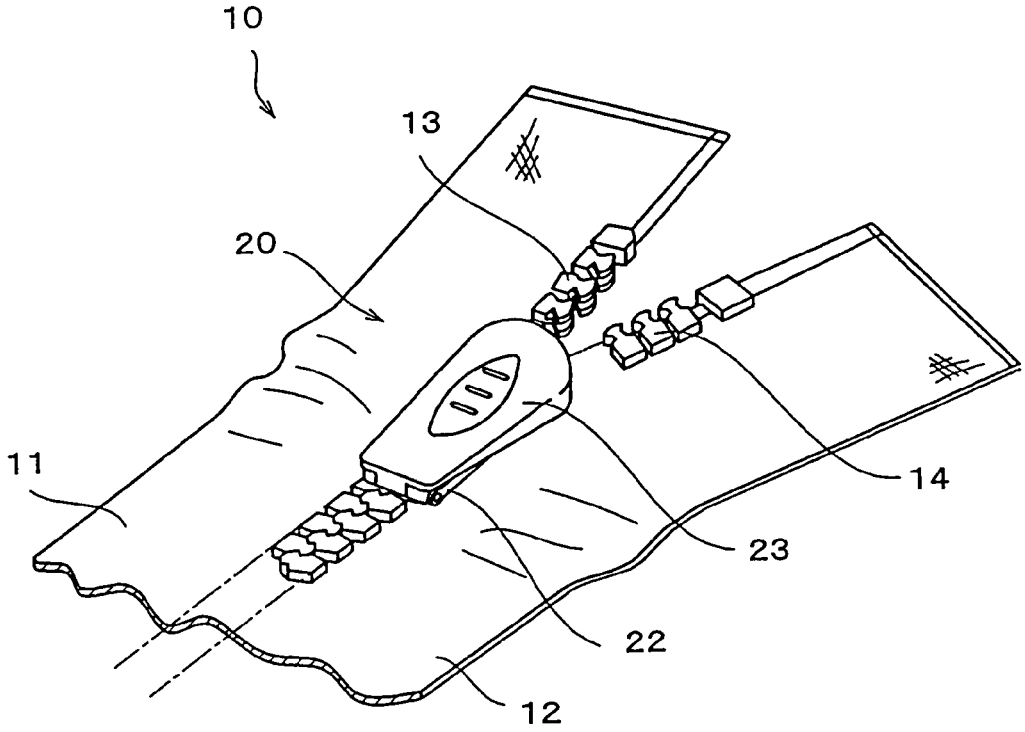
FIG. 4 is a perspective view showing part of the slider and fastener chain (first embodiment)

FIGS. 1 to 4 show a slider 20 having a cover member 23 according to a first embodiment of the present invention. FIG. 4 shows a slide fastener 10 comprising a pair of right and left fastener stringers 11, 12 such as, for example, a woven strap. The respective fastener stringers 11, 12 have continuous engaging elements 13, 14. This slide fastener 10 can be applied to an article such clothes (not shown), particularly to clothes which a motorcyclist wears. The respective fastener stringers 11, 12 are mounted on an opening of the article.

Figure 1:
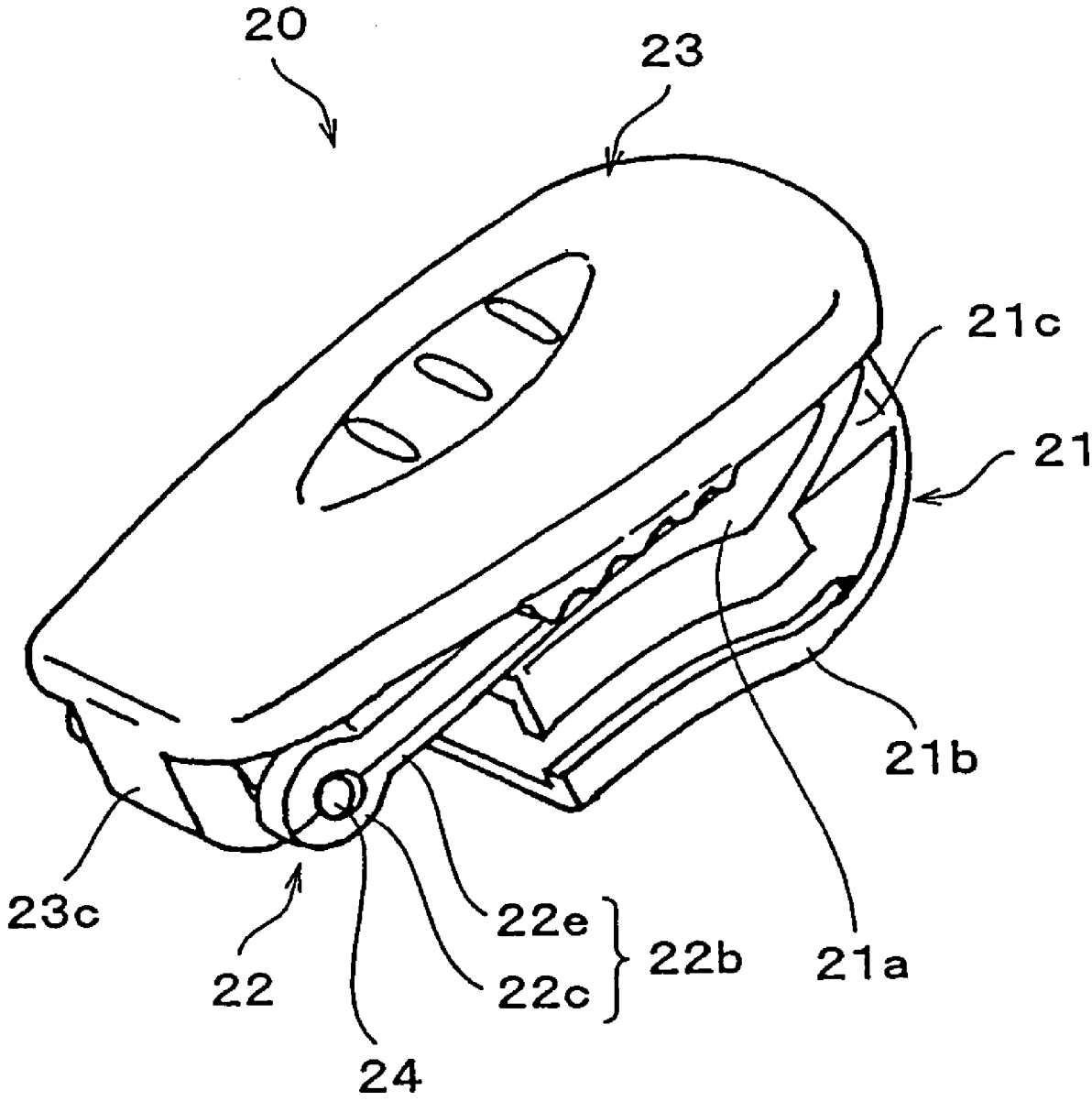
FIG. 1 is a perspective view showing a first state of a slider for a slide fastener having a cover member of the present invention (first embodiment)

As shown in FIGS. 1 to 3, the slider 20 of the slide fastener 10 comprises three members, a slider body 21 which engages with/disengages from the engaging elements 13, 14 (FIG. 4), a pull tag 22 connected to the slider body 21 so as to be capable of moving freely through a first end portion 22*a*, and a cover member 23 having a second end portion 23*b* connected so as to be capable of rotating relatively through a second end portion 22*b* located opposite to the first end portion 22*a* of the pull tag 22.

As shown in FIGS. 2 and 3, the slider 21 has upper/lower blades 21*a*, 21*b* and a guide post 21*c* for connecting the front portions of the upper/lower blades 21*a*, 21*b*. The respective upper/lower blades 21*a*, 21*b* have upper and lower flanges on the right and left sides from their rear ends to substantially the central positions. A Y-shaped engaging-element guide aisle is formed between the upper/lower blades 21*a* and 21*b*.

As shown in FIG. 2, a pull tag mounting post 21*d* having a substantially C-shaped section, is fixed on the top face of the upper blade 21*a* in the slider body 21, the pull tag mounting post 21*d* having a post portion at each of front and rear end portions. The front end post portion of the pull tag mounting post 21*d* is molded integrally with the top face of the front end portion of the upper blade 21*a* such that it is erected. The bottom end of the rear end post portion of the pull tag mounting post 21*d* is disposed so as to be floated from the top face of the upper blade 21*a* with a gap formed, the gap allowing a first end portion 22*a* of the pull tag 22 to insert.

A rotating portion 23*c* projecting to an inner face of the central portion of the second end portion 23*b* in the cover member 23 is connected with a rotating portion 22*c* at the second end portion 22*b* of the pull tag 22 so as to be capable of rotating relatively as shown in FIG. 2. The first end portion 23*a* of the cover member 23 is capable of rotating relatively from a first position (FIG. 1) for covering and concealing the slider body 21 and the pull tag 22 in an immobile state to a second position (FIG. 2) for exposing the slider body 21 and the pull tag 22.

The prominent feature of the present invention exists in that the cover member 23 and the pull tag 22 have engaging/disengaging means for engaging with/disengaging from each other in a rotation space which allows a relative rotation of the pull tag 22 and the cover member 23 between the respective second end portions 22*b* and 23*b* when the cover member 23 is located at the first position for concealing at least the pull tag 22 in the immobile state. The respective second end portions 22*b*, 23*b* of the cover member 23 and the pull tag 22 of the present invention refer to the portions in which the cover member 23 and the pull tag 22 rotate each other relatively. The respective second end portions 22*b*, 23*b* include the rotating portions 22*c*, 23*c*. The cover member 23 and the pull tag 22 are connected through the respective rotating portions 22*c*, 23*c* such that they are capable of rotating relatively.

According to the present invention, the engaging/disengaging means can be provided at portions on the side of the respective first end portions 22*a*, 23*a* apart from the rotating portions 22*c*, 23*c*, at the second end portions 22*b*, 23*b* of the pull tag 22 and the cover member 23. Consequently, part of the second end portions 22*b*, 23*b*, which connect the pull tag 22 and the cover member 23 such that they are capable of rotating relatively, can be used effectively as an engaging/disengaging means.

According to this indicated example, as shown in FIG. 2, the rotating portion 22*c* of the pull tag 22 can be formed at a front end of each of a pair of right and left arm portions 22*e*, 22*e*. The rotating portion 23*c* of the cover member 23 can be formed with a projecting portion which projects to the inner face of the central portion on the side of the second end portion 23*b* in the cover member 23 as shown in FIG. 2.

FIGS. 1 to 3, 5 and 6 show a preferable structure of the engaging/disengaging means for engaging with/disengaging from each other between the second end portion 22*b* of the pull tag 22 and the second end portion 23*b* of the cover member 23 when the cover member 23 is located at the first position for concealing at least the pull tag 22 in the immobile state. According to a shown typical first embodiment, the pull tag 22, as shown in FIG. 2, has a ring-like first end portion 22*a* having a central space portion which allows itself to move freely with respect to the pull tag mounting post 21*d* of the slider body 21. This first end portion 22*a* is hooked by the pull tag mounting post 21*d* through the central space portion.

Further, the pull tag 22, as shown in FIG. 2, has a second end portion 22*b* having a fork-like shape with a joint lever 22*d* formed so as to transverse the central space portion of the first end portion 22*a* as a proximal end portion thereof. The rotating portion 22*c* of this second end portion 22*b* can be formed in the pair of right and left arm portions 22*e*, 22*e* which constitute part of the engaging/disengaging means. A rotation space which allows the rotating portion 23*c* of the cover member 23 to rotate is formed between the respective arm portions 22*e*.

This pull tag 22 and the cover member 23 may be formed integrally, for example, by two-color extrusion or insert molding. The present invention is not restricted to this example, but the respective arm portions 22*e* of the pull tag 22 and the rotating portion 23*c* of the cover member 23 may be connected by inserting a pin 24 between the rotating portion 23*c* of the cover member 23 and the arm portions 22*e* of the pull tag 22 and fixed thereto.

On the other hand, as shown in FIGS. 2 and 3, the cover member 23 can be constructed with a substantially curved member having a smooth convex curved face at its top surface. In an inner face in the central portion on the side of the first end portion 23*a* of the cover member 23, a narrow groove-like accommodating concave portion 23*d* is formed so as to be held by an upper end portion of the front end post portion of the pull tag mounting post 21*d*. The rotating portion 23*c* projecting to the inner face of the central portion on the side of the second end portion 23*b* in the cover member 23 acts as part of the engaging/disengaging means which is rotatably connected between the respective arm portions 22*e* of the pull tag 22.

The rotating portion 23*c* of the cover member 23 can be formed of a block body having a top face portion which provides a semi-circular shape around the aforementioned pin 24. A engaging portion which deforms elastically when the pull tag 22 and the cover member 23 engage or disengage, is provided at a portion on the side of the first end portion 23*a* of the rotating portion 23*c*. As this engaging portion, an elastic tongue piece 23*c*-1 composed of, for example, a soft material, can be formed as shown in FIGS. 2 to 6. This elastic tongue piece 23*c*-1 can engage with or disengage from the joint lever 22*d* of the pull tag 22 made of a hard material, which is a engaging portion, when the cover member 23 is located at the first position for concealing at least the pull tag in the immobile state.

The material of the cover member 23 of the present invention is not restricted to any particular one, but for example, a soft material such as plastic, rubber and leather can be employed. If the cover member 23 is formed of such a soft material, naturally a softness feeling can be obtained excellently on its appearance, and further, even when the cover member 23 collides with each component, no sound irritating a user is generated. Thus, the user can be protected from a discomfort feeling.

Further, even if the slider 20 comes into contact with part of the human body, for example, the fingers when user exercises a violent sport, the fingers are protected from a damage because the slider body 21 and the pull tag 22 are covered with the soft cover member 23. Moreover, because the cover member 23 is made of a soft material, the cover member 23 can be engaged with or disengaged from the pull tag 21 easily.

Figure 5:
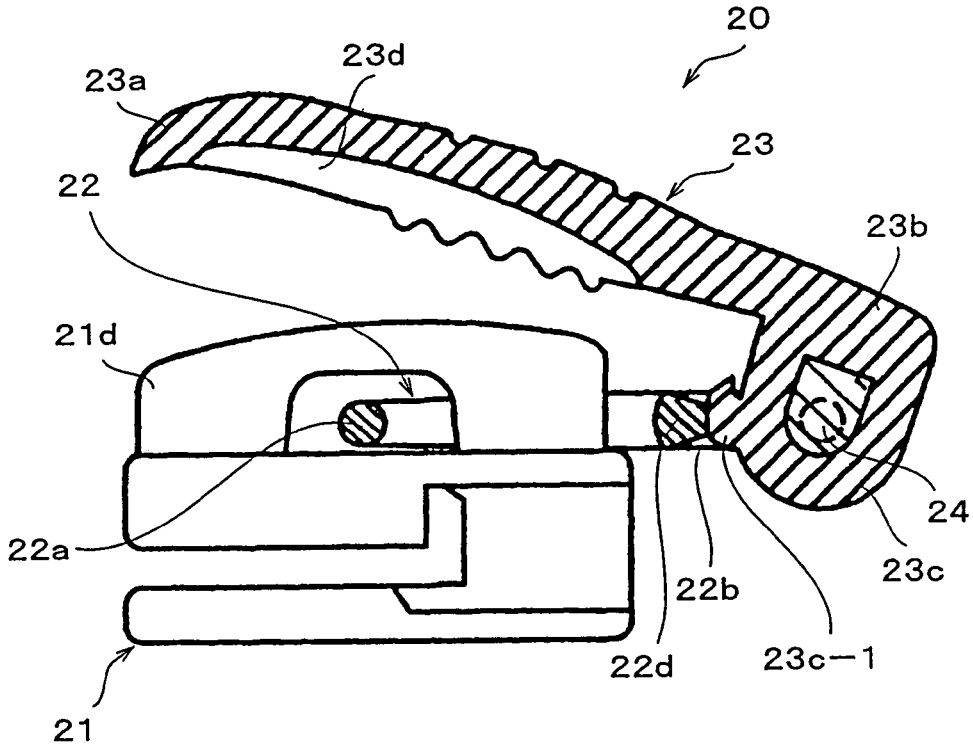
FIG. 5 is a sectional side view of major portions showing that the slider is located just before the first state (first embodiment)
Figure 6:
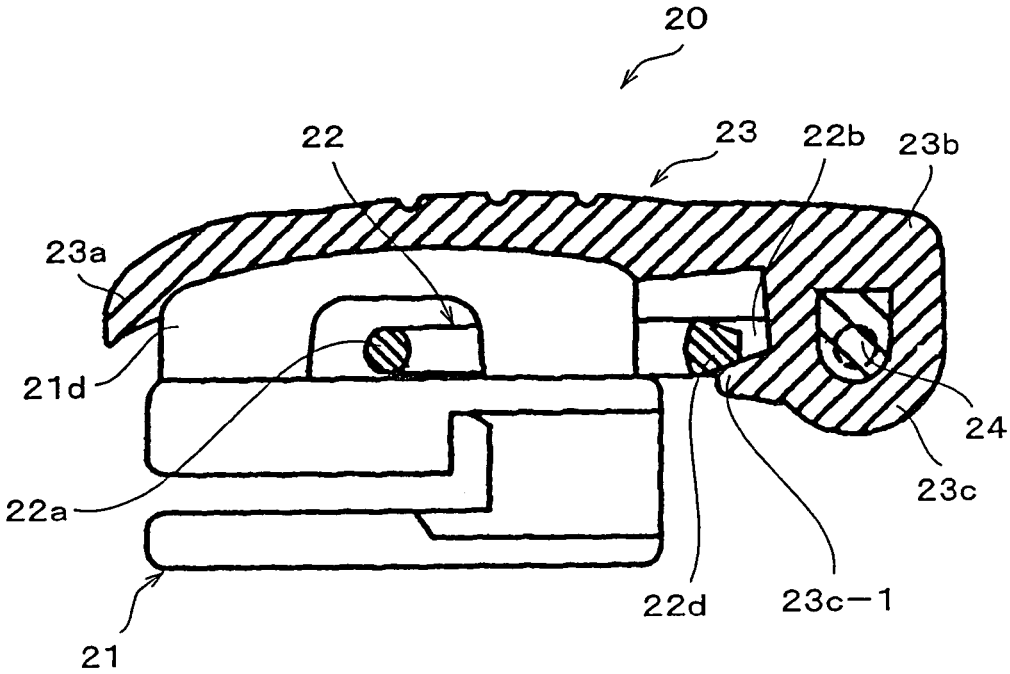
FIG. 6 is a sectional side view of major portions showing a second state of the slider (first embodiment)

Now assume that the user grips the first end portion 23*a* of the cover member 23 with his fingers and rotates the cover member 23 from the second position (FIG. 2) to the first position (FIG. 1). If the elastic tongue piece 23*c*-1 of the cover member 23 is inserted into the rotation space between the respective arm portions 23*e* of the pull tag 22 with a rotation of the cover member 23, the front end portion of the elastic tongue piece 23*c*-1 deforms elastically in an opposite direction to a direction in which the cover member 23 rotates by the joint lever 22*d* of the pull tag 22 as shown in FIGS. 5 and 6. Due to this elastic deformation, the front end portion of the elastic tongue piece 23*c*-1 invades into the rotation space between the respective arm portions 22*e*, and passes the engaging face of the joint lever 22*d*. At the same time when the front end portion of the elastic tongue piece 23*c*-1 passes the engaging face of the joint lever 22*d*, the front end portion of the elastic tongue piece 23*c*-1 restores elastically. Consequently, the joint lever 22*d* and the elastic tongue piece 23*c*-1 can engage with each other.

If the user grips the first end portion 23*a* of the cover member 23 with his fingers and rotates the cover member 23 from the first position (FIG. 1) to the second position (FIG. 2) in order to remove the cover member 23 from the slider body 21, the front end portion of the elastic tongue piece 23*c*-1 of the cover member 23 deforms elastically by an operation opposite to the above-described operation. Consequently, the elastic tongue piece 23*c*-1 can be removed from between the respective arm portions 23*e* of the pull tag 22, so that the engaging condition between the joint lever 22*d* and the elastic tongue piece 23*c*-1 can be released.

Due to provision of the engaging/disengaging means having such a structure, when the cover member 23 is located at the first position for concealing at least the pull tag 22 in the immobile state, the pull tag 22 and the cover member 23 can be securely fixed to the slider body 21. Consequently, the pull tag 22 can be prevented from deflecting from the slider body 21. Further, a relative movement between the pull tag 22 and the cover member 23 can be prevented. Thus, the quality of the slider 20 can be secured over a long period.

Second Embodiment

Figure 7:
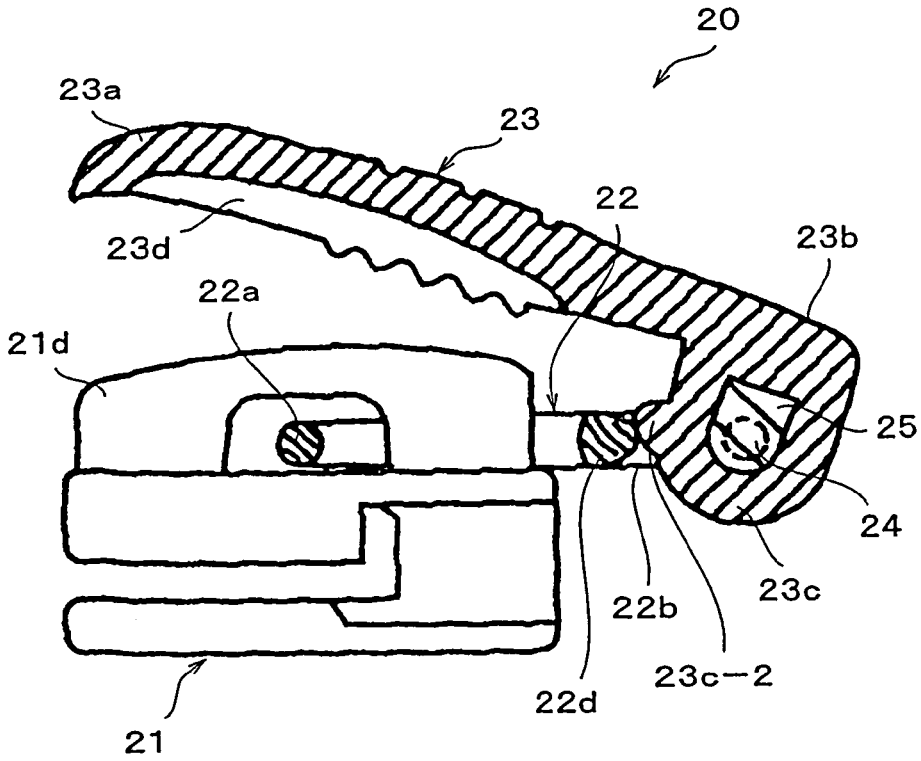
FIG. 7 is a sectional side view of major portions showing that a slider having a cover member of another structure example of the present invention is located just before a first state (second embodiment)
Figure 8:
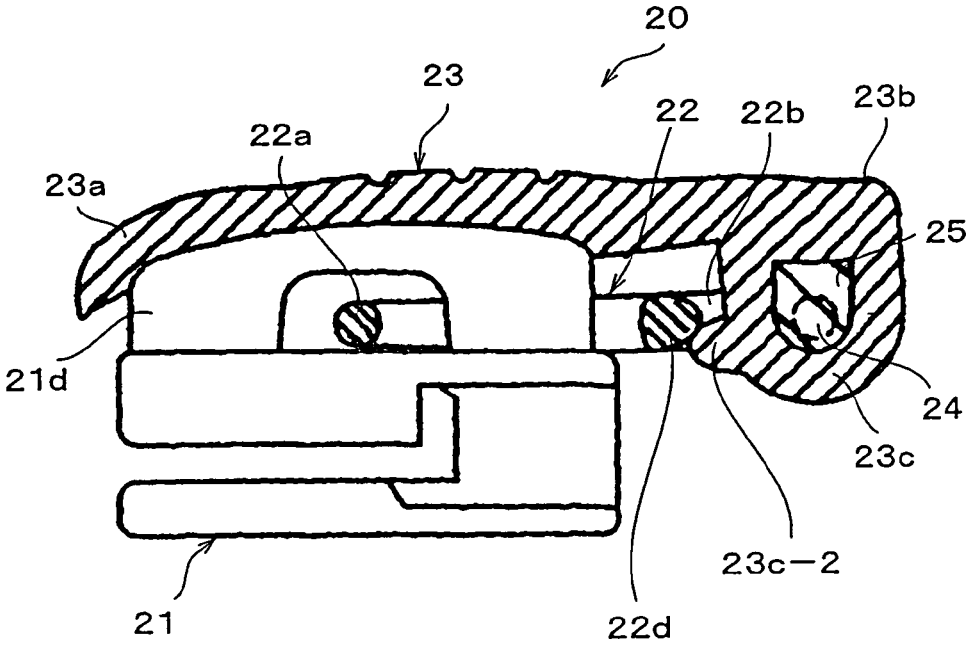
FIG. 8 is a sectional side view of major portions showing a second state of the slider (second embodiment)

FIGS. 7 and 8 show another typical structure of the engaging/disengaging means for engaging with/disengaging from the second end portions 22*b*, 23*b* when the cover member 23 is located at the first position for concealing at least the pull tag 22 in the immobile state. In these figures, reference numerals are attached to substantially the same components as the first embodiment. Therefore, the detailed description of these components is omitted.

FIGS. 9 to 15 show another typical structure of the engaging/disengaging means for engaging with/disengaging from the second end portions 22*b*, 23*b* when the cover member 23 is located at the first position for concealing at least the pull tag 22 in the immobile state. Since in these embodiments, reference numerals are attached to substantially the same components as the first embodiment, the detailed description of these components is omitted.

According to the present invention, various types of engaging/disengaging means can be provided depending on the configuration and structure of the second end portions 22*b*, 23*b* of the pull tag 22 and the cover member 23. That is, according to the typical structure of the engaging/disengaging means, the engaging/disengaging means for engaging with/disengaging from the second end portions 22*b*, 23*b* when the cover member 23 is located at the first position for concealing at least the pull tag 22 in the immobile state can be formed into a simple structure without forming the second end portions 22*b*, 23*b* of the pull tag 22 and the cover member 23 into any special structure.

FIGS. 7 and 8 show a second embodiment of the slider 20 of the present invention. The second embodiment is largely different from the first embodiment in that a projecting portion 23*c*-2 which engages and disengages forcibly when engaging with/disengaging from the pull tag 22 and the cover member 23 is provided at a portion on the side of the first end portion 23*a* of the rotating portion 23*c* of the cover member 23 and that this projecting portion 23*c*-2 is composed of a cam face made of a hard material.

According to the second embodiment, a pin 24 is fixed to and integrated with the cover member 23 made of a hard material such as an elastic metallic material through an intermediate member 25 made of an elastic material such as a rubber material fixed within its rotating portion 23*c*. When the cover member 23 is rotated toward the second position (FIG. 8), the cam face of the projecting portion 23*c*-2 can be slid with keeping a firm contact with the engaging face of the joint lever 22*d* in the pull tag 22 made of a hard material depending on a rotation of the cover member 23. Consequently, contact pressure can be partially increased at the contact portion.

At this time, a portion of the intermediate portion 25 on the projection side can be pressed outward relative to the pin 24 and deformed. Due to this deformation with pressure, the cam face of the projecting portion 23*c*-2 invades into the rotation space between the respective arm portions 22*e*, and passes the engaging face of the joint lever 22*d*. At the same time, the intermediate member 25 restores elastically. If this intermediate member 25 restores elastically, the cam face of the projecting portion 23*c*-2 and the joint lever 22*d* of the pull tag 22 can be disposed in the rotation space between the respective arm portions 22*e* in the pull tag 22 such that they oppose each other.

Consequently, when the cover member 23 is located at the first position for concealing at least the pull tag 22 in the immobile state, the joint lever 22*d* can be engaged with the cam face of the projecting portion 23*c*-2. Contrary to this, when the cam face of the projecting portion 23*c*-2 is rotated relatively apart from the engaging face of the joint lever 22*d*, the contact pressure can be reduced. Consequently, the rotating portions 22*c*, 23*c* of the pull tag 22 and the cover member 23 can be engaged with/disengaged from each other.

The second embodiment also enables cheap engaging/disengaging means to be obtained with a simple structure without increasing the quantity of its components like the first embodiment. Of course, the cam face which fits to or separates from the cam face of the projecting portion 23*c*-2 can be formed smoothly on part of the engaging face of the joint lever 22*d* in the pull tag 22.

Although as the-second embodiment, a structure in which the pin 24 is fixed and integrated through the intermediate member 25 fixed within the rotating portion 23*c* in the cover member 23 has been described, the present invention is not restricted to this example. According to the present invention, even if the pin 24 is composed of an elastic metallic material without using the intermediate member 25, the same effect can be exerted.

Third Embodiment

Figure 9:
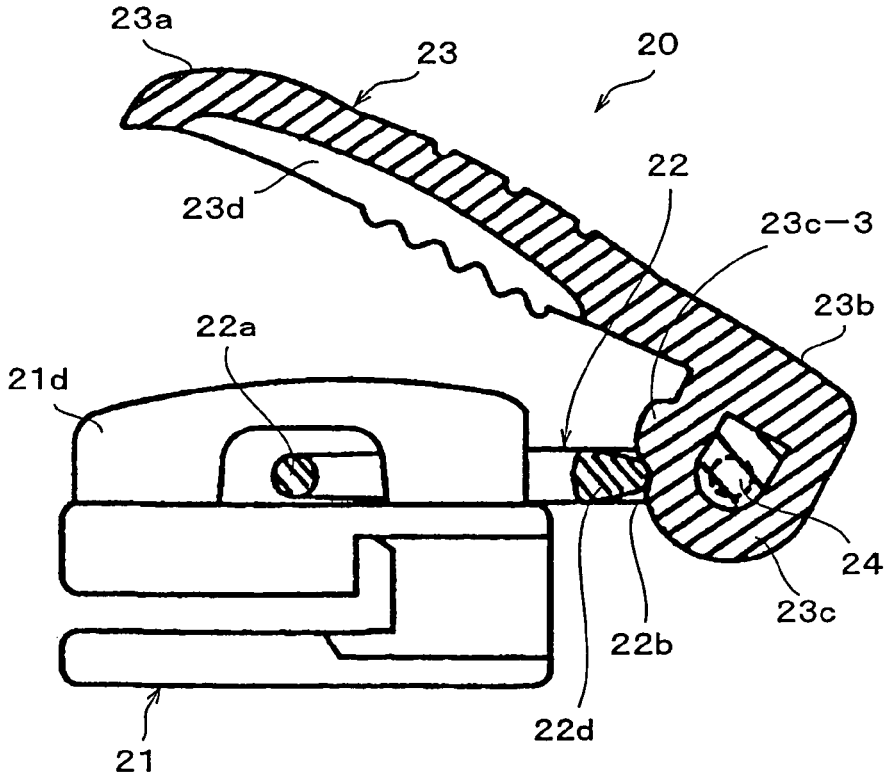
FIG. 9 is a sectional side view of major portions showing that a slider having a cover member of still another structure example of the present invention is located just before a first state.
Figure 10:
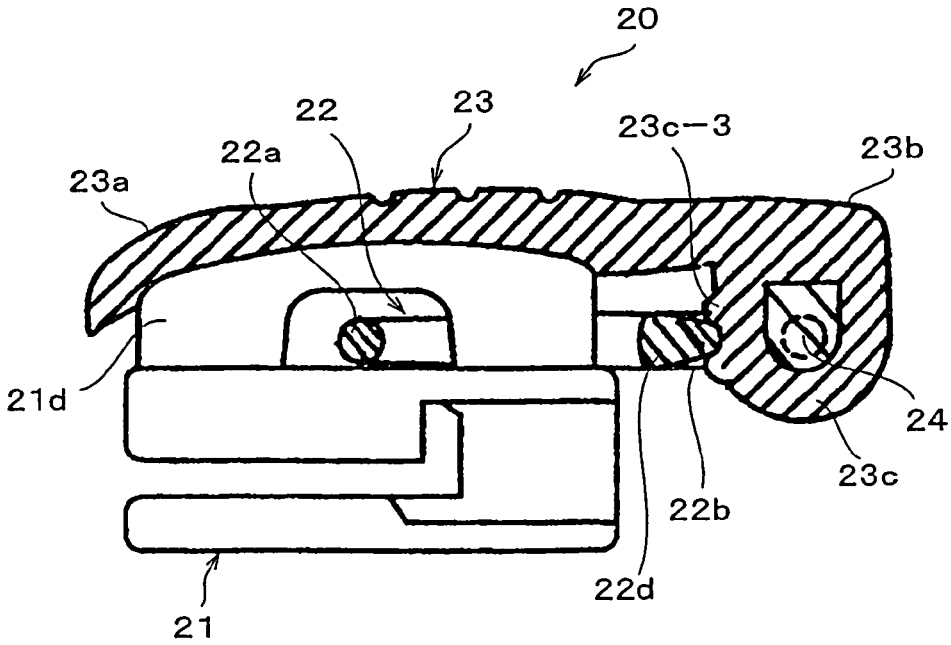
FIG. 10 is a sectional side view of major portions showing a second state of the slider (third embodiment)

FIGS. 9 and 10 show a third embodiment of the slider 20 of the present invention. According to the third embodiment, a engaging portion, which is pressed and deformed when the pull tag 22 and the cover member 23 are engaged or disengaged, can be provided as engaging/disengaging means for engaging with/disengaging from the second end portions 22*b*, 23*b* of the pull tag 22 and the cover member 23, at a portion of the rotating portion 23*c* of the cover member 23 on the side of the first end portion 23*a*. This engaging portion can be constructed of an elastic body 23*c*-3 made of a soft material such as plastic or rubber.

The configuration and structure of this elastic body 23*c*-3 are not restricted to the indicated example. When the cover member 23 is located at the first position (FIG. 10), the elastic body 23*c*-3 and the joint lever 22*d* of the pull tag 22 made of a hard material can be disposed within the rotation space between the respective arm portions 22*e* in the pull tag 22 such that they oppose each other. Consequently, the respective rotating portions 22*c*, 23*c* of the pull tag 22 and the cover member 23 can be engaged or disengaged. According to the third embodiment as well, when the cover member 23 is located at the first position for concealing at least the pull tag 22 in the immobile state, the engagement between the pull tag 22 and the cover member 23 is never lost, so that they can be secured firmly, like the respective embodiments.

Fourth Embodiment

Figure 11:
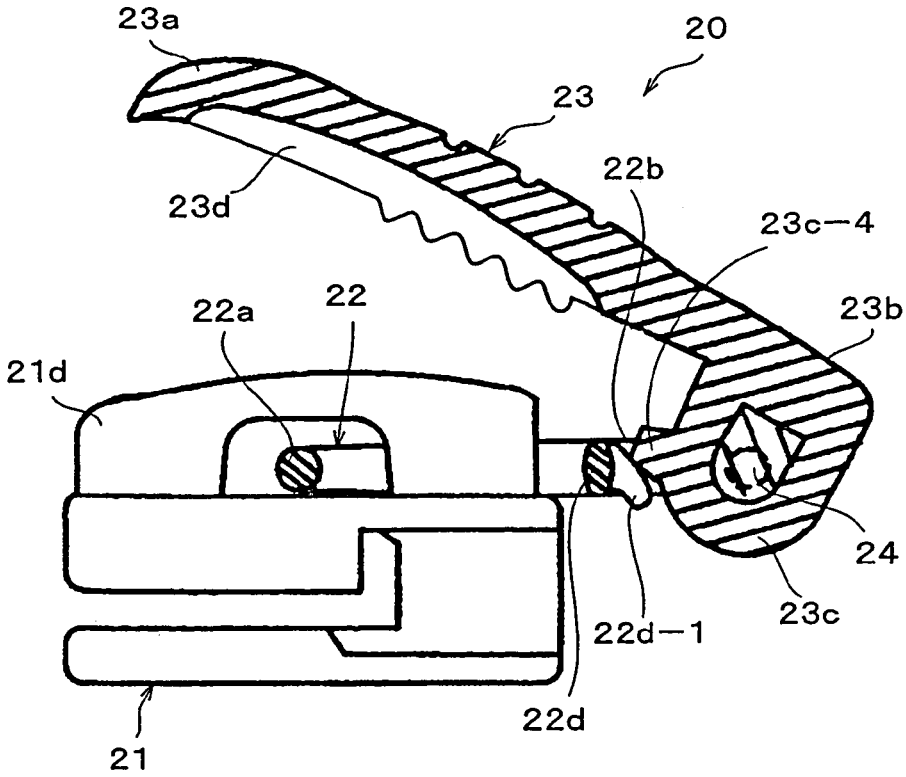
FIG. 11 is a sectional side view of major portions showing that a slider having a cover member of still another structure example of the present invention is located just before a first state (fourth embodiment)
Figure 12:
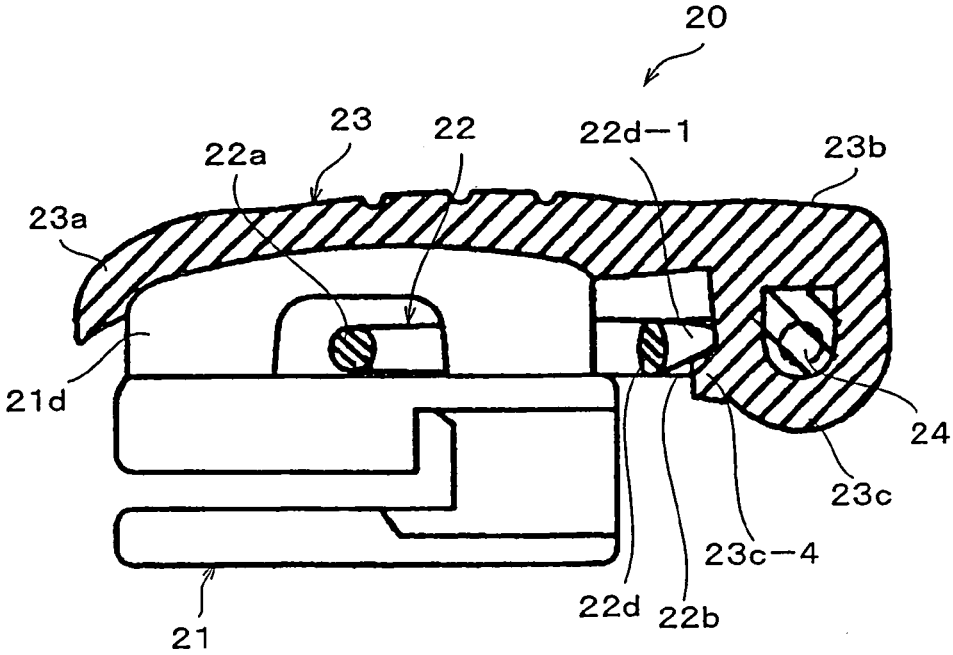
FIG. 12 is a sectional side view of major portions showing a second state of the slider (fourth embodiment)

FIGS. 11 and 12 show a fourth embodiment of the slider 20 of the present invention. According to the fourth embodiment, it is possible to form an elastic tongue piece 22*d*-1 on the joint lever 22*d* in the pull tag 22 made of a hard material as engaging/disengaging means for engaging with/disengaging from the second end portions 22*b*, 23*b* of the pull tag 22 and the rotating portion 23, instead of the elastic tongue piece 23*c*-1 provided at the portion of the rotating portion 23*c* of the cover member 23 on the side of the first end portion 23*a*.

On the other hand, a projecting portion 23*c*-4 can be formed of a hard material on at least the rotating portion 23*c* of the cover member 23. When the cover member 23 is located at the first position (FIG. 12), the elastic tongue piece 22*d*-1 and the projecting portion 23*c*-4 can be engaged/disengaged. According to the fourth embodiment as well, when the cover member 23 is located at the first position for concealing at least the pull tag 22 in the immobile state, the pull tag 22 and the cover member 23 can be engaged securely like the respective embodiments described above, and as a consequence, inexpensive engaging/disengaging means can be obtained with a simple structure.

Fifth Embodiment

Figure 13:
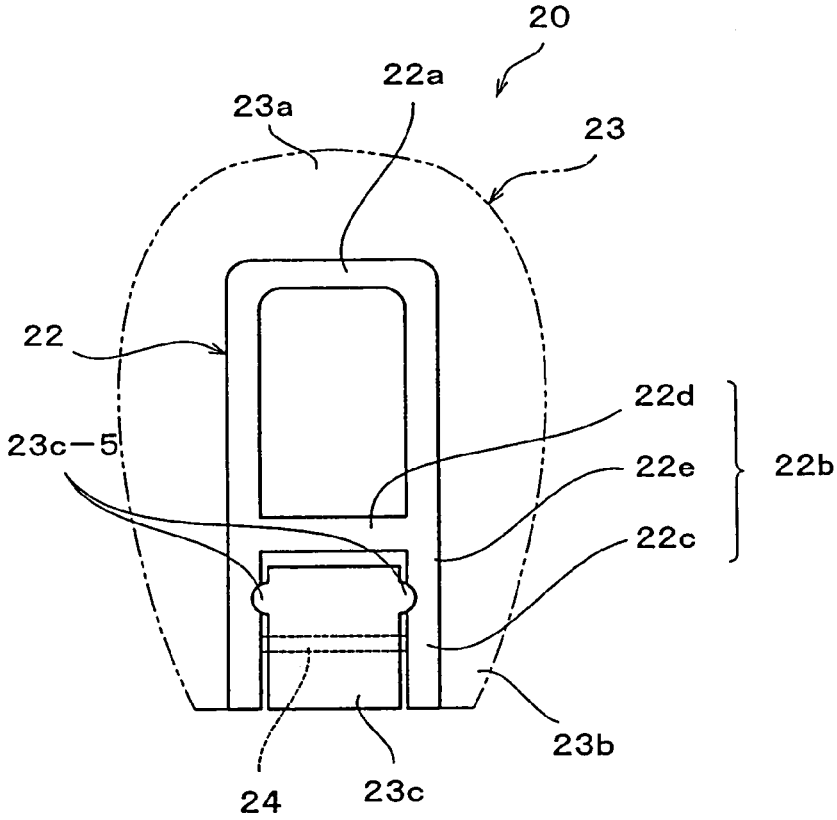
FIG. 13 is a rear view of major portions showing a second state of a slider having a cover member of still another structure example of the present invention (fifth embodiment)

FIG. 13 shows a fifth embodiment of the slider of the present invention. In the same figure, the slider body is not drawn in order to avoid a redundancy of explanation. According to the fifth embodiment, it is possible to provide engaging/disengaging means for engaging with/disengaging from an inner face of the arm portion 22*e* of the pull tag 22 and an outer face of the rotating portion 23*c* in the cover member 23, instead of the engaging/disengaging means for engaging with/disengaging from the rotating portion 23*c* of the cover member 23 and the joint lever 22*d* of the pull tag 22. As the engaging/disengaging means, for example, a projecting portion 23*c*-5 and a concave portion can be set up appropriately.

Although according to the fifth embodiment, the projecting portion 23*c*-5 is provided on the inner face of the arm portion 22*e* of the pull tag 22 while the concave portion is provided in the outer face of the rotating portion 23*c* in the cover member 23, the present invention is not restricted to this example. The engaging/disengaging means for engaging with/disengaging from the second end portions 22*b*, 23*b* of the pull tag 22 and the cover member 23 may be constructed with a projecting row or projecting portion formed on the inner face of the arm portion 22*e* in the pull tag 22 and a step portion, a fitting hole or a concave portion formed in the outer face of the rotating portion 23*c* in the cover member 23. Of course, the engaging/disengaging portion can be constructed by combining the projecting row, projecting portion, step portion, fitting hole or concave portion appropriately.

By providing with the engaging/disengaging means of the second to fifth embodiments, the engaging/disengaging means can be constructed with a simple structure in order to avoid formation of a complicated structure. Further, the engaging area between the engaging portion and the engaged portion can be set up appropriately. Thus, a sufficient holding force between components can be secured. The engaging/disengaging means can be constructed with a simple structure so as to avoid formation of a complicated structure. As a result, reduction in size and thinning of the entire slider 20 can be achieved and its handling is facilitated.

Sixth Embodiment

Figure 14:
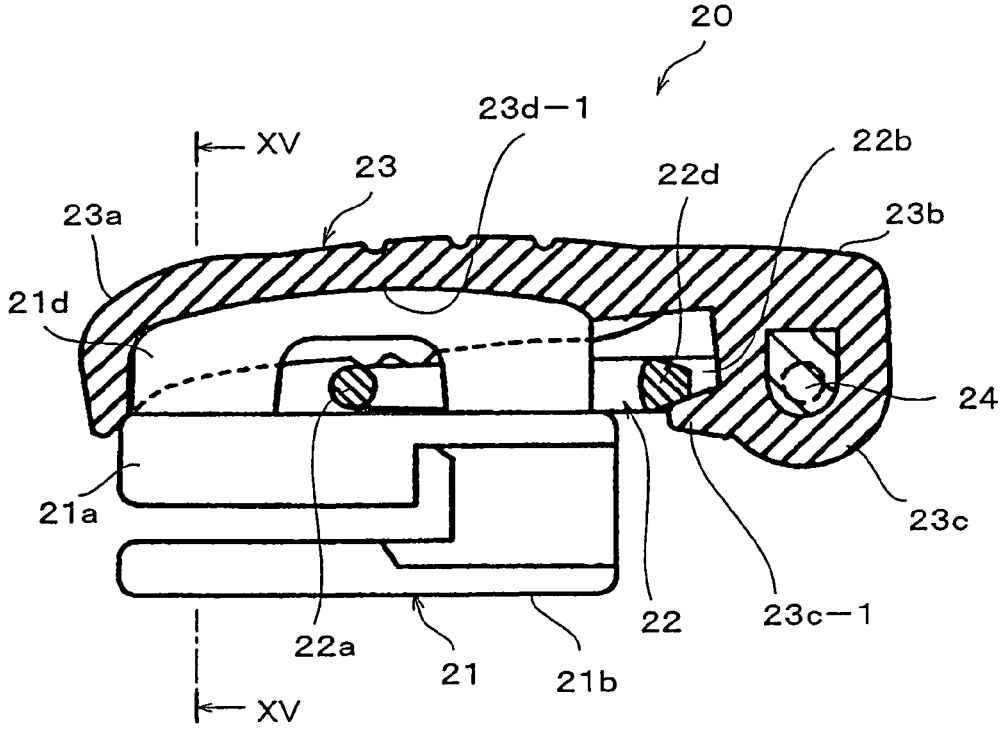
FIG. 14 is a sectional side view of major portions showing a modification of the cover member in the slider shown in FIG. 1 (sixth embodiment)
Figure 15:
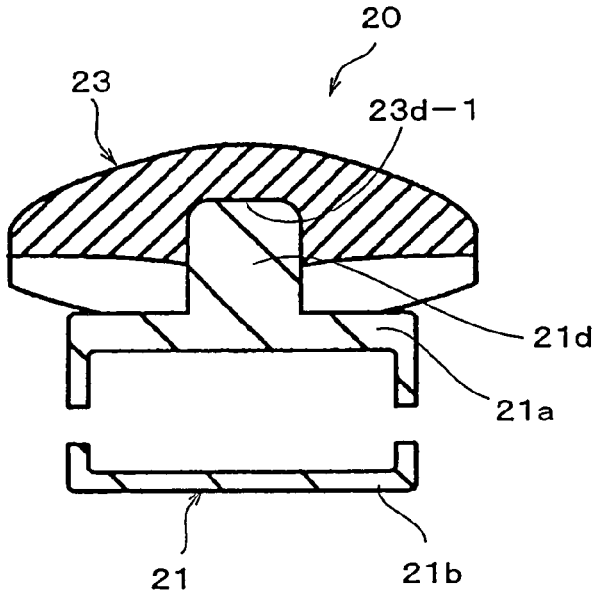
FIG. 15 is a sectional view seen in the direction of the arrow along the line XV-XV in FIG. 14 (sixth embodiment)
Figure 16:
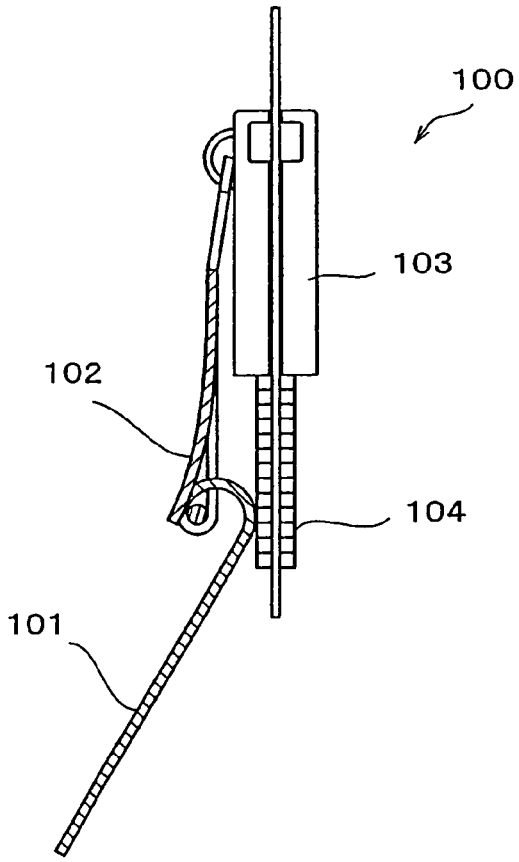
FIG. 16 PRIOR ART
FIG. 16 is a sectional view of major portions of a slider having a conventional cover member.

FIGS. 14 and 15 show another example of the structure of the narrow groove-like accommodating concave portion 23*d* held above the front end post portion of the pull tag mounting post 21*d*. The cover member 23 of the sixth embodiment is comprised of right/left side wall portions formed on the right and left side of the top wall portion having a smooth convex curve face on its top surface and a front wall portion for joining the top wall portion and the right/left side wall portions. In the region of the accommodating concave portion 23*d*-1 of the cover member 23, the cover member 23 has a substantially fallen C-shaped section. This accommodating concave portion 23*d*-1 is formed up to the front face of the front end post portion of the pull tag mounting post 21*d* formed integrally on the top face of the front end portion of the upper blade 21*a* such that it is erected. The configuration of this accommodating concave portion 23*d*-1 can be set up appropriately depending on the configuration and size of the cover member 23 and the slider body 21. As a result, the cover member 23 can be guided to the pull tag mounting post 21*d* accurately and stably.

When matching the accommodating concave portion 23*d*-1 in the cover member 23 with the pull tag mounting post 21*d* of the slider body 21, positioning thereof in the back and forth direction and width direction can be achieved. The pull tag mounting post 21*d* of the slider body 21 can be fit to the accommodating concave portion 23*d*-1 in the cover member 23 securely in an immobile state without exposing any special fitting structure outside of the cover member 23 and the slider body 21. When the cover member 23 engages the slider body 21, that is, when the cover member 23 is located at the first position (FIG. 14) for concealing at least the pull tag 22 in the immobile state, the pull tag mounting post 21*d*, the pull tag 22 and the cover member 23 can be fitted completely. Thus, a play or deflection between components can be suppressed and those components can be supported and fixed firmly and securely.

Thus, even if a force which intends to jump up the cover member 23 with respect to the pull tag mounting post 21*d* is applied directly on the cover member 23 when the cover member 23 is located at the first position for concealing at least the pull tag 22 in the immobile state, the pull tag 22 and the cover member 23 are protected from moving in the back/forth direction, right/left direction, oblique direction and vertical direction by the engagement between the pull tag 22 and the cover member 23. As a result, the holding force for the cover member 23 can be increased thereby intensifying the durability of the slider 20.

Therefore, this cover member 23 has only to have a simple structure and does not have to be constructed in a complicated structure. By setting up the configuration and the size of the accommodating concave portion 23*d*-1 in the cover member 23 appropriately depending on the configuration and size of the pull tag mounting post 21*d*, reduction in size and thinning of the slider 20 can be achieved. In the meantime, the accommodating concave portion 23*d*-1 only needs to be formed inside the right and left side wall portions of the cover member 23.

The preferred embodiments of the present invention have been described above and although the respective embodiments indicate a structure example including the pair of right and left arm portions 22*e*, 22*e* having the rotation space allowing a relative rotation between the second end portion 22*b* of the pull tag 22 and the second end portion 23*b* of the cover member 23, the present invention is not restricted to this example. For example, it is permissible to construct the rotating portion of the pull tag 22 with a block-like rotating portion and then, the rotating portion of a mating cover member 23 with the pair of right and left arm portions.

As the structure of the engaging/disengaging means, a structure in which the rotating portion 23*c* of the cover member 23 is provided with the elastic tongue piece 23*c*-1 which deforms elastically, the cam face 23*c*-2 which engages forcibly or the elastic body 23*c*-3 which is pressed and deformed when the pull tag 22 and the cover member 23 are engaged/disengaged, while the joint lever 22*d* is provided-on the rotating portion 22*c* of the pull tag 22, and a structure in which the joint lever 22*d* of the pull tag 22 is provided with the elastic tongue piece 22*d*-1 which deforms elastically when the pull tag 22 and the cover member 23 are engaged/disengaged while the projecting portion 23*c*-4 is provided on the rotating portion 23*c* of the cover member 23 have been exemplified. It is needless to say that the object of the present invention can be achieved sufficiently by using any one or any combination of the above-described engaging/disengaging means for the relation with other factors such as the configuration and size of the slider body 21 and the pull tag mounting post 21*d*.

The present invention does not restrict the materials of the rotating portions 22*c*, 23*c* of the pull tag 22 and the cover member 23 to any particular one and for example, the cover member 23 may be formed of a hard material such as metal or a soft material such as plastic, rubber or leather. Thus, needless to say, the present invention is not restricted to the above-described embodiments but may be modified in various ways within the scope described in respective claims attached to this specification.

What is claimed is:

1. A slider for a slide fastener, comprising:

a slider body for engaging/disengaging engaging elements of a pair of fastener stringers;

a pull tag connected to the slider body through a first end portion of the pull tag so as to be capable of moving freely; and a cover member including a second end portion of the cover member having a rotating portion of the cover member coupled with the pull tag through a rotating portion of the pull tag on the second end portion of the pull tag on an opposite side of the first end portion of the pull tag so as to be capable of rotating relatively, the first end portion of the cover member on an opposite side to the second end portion of the cover member being rotatable between a first position at which the pull tag is concealed in an immobile state and a second position at which the pull tag is exposed, wherein the rotating portion of the pull tag is formed in a pair of right and left arm portions having a rotation space allowing the rotating portions to rotate relatively, and engaging/disengaging means for engaging with/disengaging from each other are provided in an inner side face of the arm portion in the pull tag, and in an outer side face of the rotating portion in the cover member wherein the engaging/disengaging means in the arm portion are provided between respective arm portions of the pull tag, and wherein the rotating portion of the cover member is a portion which projects to an inner face of a central portion on a side of the second end portion in the cover member.

2. A slider for a slide fastener, comprising:

a slider body for engaging/disengaging engaging elements of a pair of fastener stringers;

a pull tag connected to the slider body through a first end portion of the pull tag so as to be capable of moving freely; and a cover member including a second end portion of the cover member having a rotating portion of the cover member coupled with the pull tag through a rotating portion of the pull tag on the second end portion of the pull tag on an opposite side of the first end portion of the pull tag so as to be capable of rotating relatively, the first end portion of the cover member on an opposite side to the second end portion of the cover member being rotatable between a first position at which the pull tag is concealed in an immobile state and a second position at which the pull tag is exposed, wherein one of the rotating portions of the pull tag and the covet member is formed in a pair of right and left arm portions having a rotation space allowing the rotating portions to rotate relatively, and a joint lever for joining respective arm portions is provided at a proximal end portion of the arm portion while an other of the rotating portions of the cover member and the pull tag has engaging/disengaging means for engaging with/disengaging from the joint lever.

3. The slider for a slide fastener according to any one of claims 1 or 2, wherein one of the pull tag or the cover member has an engaging portion in which the engaging/disengaging means engages/disengages when the pull tag and the cover member are engaged/disengaged.

4. The slider for the slide fastener according to claim 3, wherein the engaging portion is constituted of an elastic tongue piece which deforms elastically.

5. The slider for the slide fastener according to claim 3, wherein the engaging portion is constituted of a projecting portion.

6. The slider for the slide fastener according to claim 5, wherein the projecting portion is constituted of a cain face made of a hard material.

7. The slider for the slide fastener according to claim 5, wherein an other of the cover member or the pull tag has an engaging/disengaging hole or a concave portion which engages with/disengages from the projecting portion.

8. The slider for the slide fastener according to claim 2, wherein the slider body has a pull tag mounting post on a part of a top surface thereof and an inner face of the cover member has an accommodating concave portion which is fit on the top end portion of the pull tag mounting post.

9. The slider for the slide fastener according to claim 2, wherein the rotating portion of the cover member is a portion which projects to an inner face of a central portion on a side of the second end portion in the cover member.

* * * * *